US007644611B2

(12) United States Patent
Kamiya et al.

(10) Patent No.: US 7,644,611 B2
(45) Date of Patent: Jan. 12, 2010

(54) DOWNHOLE FLUID ANALYSIS FOR PRODUCTION LOGGING

(75) Inventors: Akira Kamiya, Sagamihara (JP); Gary Oddie, Cambridgeshire (GB); Stephane Vannuffelen, Southampton (GB); Tsutomu Yamate, Yokohama (JP); Oliver C. Mullins, Ridgefield, CT (US); Bhavani Raghuraman, Wilton, CT (US); Albert Ballard Andrews, Wilton, CT (US); Andrew Carnegie, Kuala Lumpur (MY); Chengli Dong, Sugar Land, TX (US); Marian Faur, Palaiseau (FR); Christopher Harrison, Auburndale, MA (US); Kentaro Indo, Edmonton (CA); Li Jiang, Newton, MA (US); Michael O'Keefe, Blackmans Bay (AU)

(73) Assignee: Schlumberger Technology Corporation, Sugar Land, TX (US)

( * ) Notice: Subject to any disclaimer, the term of this patent is extended or adjusted under 35 U.S.C. 154(b) by 91 days.

(21) Appl. No.: 11/854,551

(22) Filed: Sep. 13, 2007

(65) Prior Publication Data

US 2008/0066538 A1 Mar. 20, 2008

Related U.S. Application Data

(60) Provisional application No. 60/825,725, filed on Sep. 15, 2006, provisional application No. 60/825,724, filed on Sep. 15, 2006.

(51) Int. Cl.
*E21B 49/08* (2006.01)

(52) U.S. Cl. ..... 73/152.28; 250/269.2; 250/269.1; 250/269.3; 250/269.7

(58) Field of Classification Search ..... 73/152.28
See application file for complete search history.

(56) References Cited

U.S. PATENT DOCUMENTS

| | | | | |
|---|---|---|---|---|
| 3,411,587 | A | 11/1968 | Bournazel | |
| 4,683,963 | A * | 8/1987 | Skinner | 175/66 |
| 5,147,561 | A | 9/1992 | Burge et al. | |
| 6,590,202 | B2 * | 7/2003 | Mickael | 250/269.2 |
| 6,700,115 | B2 * | 3/2004 | Mickael | 250/269.3 |
| 7,044,237 | B2 * | 5/2006 | Leuchtenberg | 175/48 |

(Continued)

FOREIGN PATENT DOCUMENTS

GB 2407109 4/2005

(Continued)

OTHER PUBLICATIONS

O.C. Mullins, G. Beck, M.E. Cribbs, T. Terabayashi, K. Kegasawa, "Downhole determination of GOR on single-phase fluids by optical spectroscopy", SPWLA 42nd Annual Symposium, Houston, Texas, Paper M, (2001).

(Continued)

*Primary Examiner*—John Fitzgerald
*Assistant Examiner*—Rodney T Frank
(74) *Attorney, Agent, or Firm*—Matthias Abrell; Jaime Castano; Dale Gaudier

(57) ABSTRACT

A downhole fluid analysis tool capable of fluid analysis during production logging that includes a phase separator and a plurality of sensors to perform analysis on the fluids collected at a subsurface location in a borehole.

23 Claims, 4 Drawing Sheets

U.S. PATENT DOCUMENTS

| | | | | |
|---|---|---|---|---|
| 7,278,496 | B2 * | 10/2007 | Leuchtenberg | 175/48 |
| 7,367,411 | B2 * | 5/2008 | Leuchtenberg | 175/48 |
| 2005/0150287 | A1 | 7/2005 | Carnegie | |

FOREIGN PATENT DOCUMENTS

| | | |
|---|---|---|
| GB | 2417913 | 3/2006 |
| GB | 2433273 | 6/2007 |
| WO | 01/98630 | 12/2001 |

OTHER PUBLICATIONS

G. Fujisawa, O.C. Mullins, C. Dong, A. Carnegie, S. Betancourt, T. Terabayashi, S. Yoshida, A.R. Jaramillo, M. Haggag, "Analyzing Reservoir Fluid Composition In-Situ in Real Time: Case Study in a Carbonate Reservoir," SPE 84092, Denver, CO, (2003).

Go Fujisawa, Soraya S. Betancourt, Oliver C. Mullins, Torleif Torgersen, Michael O'Keefe, Toru Terabayashi, Chengli Dong, Kåre Otto Eriksen, "Large Hydrocarbon Compositional Gradient Revealed by In-Situ Optical Spectroscopy," SPE #89704, ATCE, (2004).

O.C. Mullins, M. Hashem, H. Elshahawi, G. Fujisawa, C. Dong, S. Betancourt, T. Terabayashi, "Hydrocarbon compositional analysis in-situ in openhole wireline logging," SPWLA 45th Ann. Log. Symp. Jun. 6-9, The Netherlands, (2004).

* cited by examiner

DOWNHOLE FLUID ANALYSIS FOR PRODUCTION LOGGING

CROSS-REFERENCE TO RELATED APPLICATIONS

This application relates to and claims the benefit under 35 U.S.C. §119(e) of applicants' U.S. Provisional Application Ser. No. 60/825,724 entitled "Downhole Fluid Analysis for Production Logging," filed Sep. 15, 2006, and U.S. Provisional Application Ser. No. 60/825,725 entitled "Tool Layout for Downhole Fluid Analysis for Production Logging," filed Sep. 15, 2006. The disclosure of these Provisional Applications is hereby incorporated by reference as though set forth at length.

FIELD OF INVENTION

The present application relates to hydrocarbon production and more particularly to real-time analysis of downhole fluids in production for production logging.

DEFINITION

As used herein "fluid communication" or "in fluid communication" means configured to send or receive fluid to or from.

BACKGROUND OF THE INVENTION

Schlumberger, the assignee of the present application, has recently introduced Downhole Fluid Analysis (DFA) to the petroleum industry. The first commercial services of DFA are the LFA (Live Fluid Analyzer) and the CFA (Compositional Fluid Analyzer). DFA provides identification of fluid variations in real time during openhole wireline logging, enabling efficient fluid characterization and corresponding optimization of sample acquisition. DFA has contributed to the finding that hydrocarbons are often compositionally varied, not homogeneously distributed in the formation as had often been presumed.

A known problem in the petroleum industry is the identification of compartments. Currently, the routine and standard industry practice to identify compartments is to establish pressure communication. The lack of pressure communication indeed identifies separate compartments. However, the pressure equilibration in geologic time does not establish flow communication in production time. Specifically, the mismatch can be approximately 9 orders of magnitude, which is a major reason compartment identification is one of the biggest problems in the industry today.

Using DFA, it has been found that different compartments often contain different hydrocarbons. In fact, geoscientific arguments can be advanced predicting the routine observation of hydrocarbon fluid density inversions in different compartments. It is, for example, known that thermogenic gas is generally deep while heavy oil is generally shallow. Using DFA, it has become known that the large scale density inversion can project over distances as little as 6 feet.

Currently, DFA is performed on openhole and cased hole sampling tools that form a seal around a section of the borehole wall, or around the casing containing one or more holes. Thus, fluids currently contained in the formation are brought into the interior of the analysis tool where DFA is performed. As a result, measurements are restricted to station measurements.

It is highly desirable to perform DFA in a continuous manner of producing wells for at least the following reasons.

It is known that gravity, thermal gradients, biodegradation, water stripping, leaky seals, realtime charging, multiple charging, and miscible sweep fluid injection all contribute to compositional variation. It is also known that gravity and thermal gradients move a column towards equilibrium. However, modeling is totally unreliable for factors moving the hydrocarbons towards disequilibrium. Consequently, optimal production mandates extensive data acquisition. That is, spatial variation of hydrocarbons in the reservoir dictates time dependent hydrocarbon properties in production, which can have significant implications in production optimization. For example, the GOR of produced fluids will vary during production. If the GOR increases due to drainage of higher GOR volumes, or due to break through of (miscible) gas injection, then the gas handling capabilities of existing facilities can be exceeded. Therefore, production, and thus the oil flow rate must be reduced. Moreover, because gas is often reinjected it would be desirable to identify what zones are producing high gas cut fluids. Of course, the gas might be dissolved downhole. Reduction of production from these zones would enable increased oil flow.

In addition, production around phase transitions is complicated. For retrograde dew fields, for example, it can be optimal to produce below dew point, with concomitant gas reinjection to effectively blow dry the formations. Thus, it would be highly desirable to measure the condensate-gas ratio as a function of depth in the formation.

It is also known that the production of dry gas would mean that gas is simply being circulated indicating that production should be terminated. Use of $N_2$ as a pressure maintenance fluid (as is done in large fields in Mexico) mandates detection of dissolved $N_2$ to understand reservoir dynamics. Moreover, $C0_2$ vs. $CH_4$ production can vary substantially zone by zone and can change with time. $H_2S$ production is highly variable spatially and temporally from different zones. It is essential that the resultant surface $H_2S$ concentration not exceed specifications of existing facilities. Thus, identification and production reduction of offending zones is critical to optimal production.

Aquifer drive coupled with water injection is routinely performed in the industry. There is a very important issue associated with aquifer connectivity. Obviously, water injection wells must target the appropriate water zones for efficient sweep. Determination of water zone connectivity can be performed with water analysis. For example, pH is a sensitive determinant for distinguishing waters. pH cannot be measured properly in the lab for oil field waters due to lab requirements of low pressure and temperature. Thus, measuring pH downhole is an excellent method to address water zone connectivity.

In addition to measuring compositional information, one could imagine capturing a sample and modifying it to measure a transition pressure (or temperature). For example, a sample of light oil could be transferred to a cell where the pressure can be adjusted, allowing for the monitoring of the dew point. Information related to the dew point is important in that if the production pressure for a fluid is set incorrectly, the dew might be dropped in the formation. Given that gas has a higher mobility and thus flows preferentially, measuring the dew point pressure in production logging (PL) would help guide production parameters such as the appropriate production pressures.

Measuring asphaltene onset pressures can also be important. Specifically, it can be important to adjust pressures to control the physical location of asphaltene flocculation to avoid, for example, asphaltene flocculation in the formation. To this end, optimal pressure selection aided by the proper and accurate information obtained during production logging would allow for better production without phase behavior problems, as well as the addition of treatment chemicals when necessary, which is far more effective if confined to the borehole.

It is desirable, therefore, to have a Production Logging (PL) tool that includes sensors to measure physical and chemical properties of formation fluids in real time during the logging run.

SUMMARY OF THE INVENTION

In practice, production fluids are extracted from different pay zones, and depending on conditions of pressure and temperature the production fluids can be multiphase, i.e., water, oil and gas. Fluid conditions in producing environments are, therefore, much more complex than in the exploration phase of oilfield exploration and development.

It is known that while some sensor technologies can be used in both oil and water (e.g. viscosity or density sensors) others are fluid sensitive and can measure either a water based parameter or an oil based parameter. Moreover, the measurement quality or in the worst case physical integrity of a sensor can be compromised by contact with the wrong fluid phase. In addition, if the size of a mass containing a single phase is smaller than the size of the sensor, the sensor may make inaccurate measurements. In particular, if the sensor size is larger than the droplet size or if the sensor time constant is slower than the rate of fluid phase velocity, then erroneous interpretation can easily follow. Often the sensors are unable to distinguish whether multiple phases are being measured simultaneously adding to uncertainty. Small droplets can easily occur if one fluid is injected into a different fluid at high velocity. For example, if oil injection perforations are located in a standing water column, then a colloidal suspension can result. This is a known problem with existing phase detection sensors. As a result, fluids containing two or more immiscible phases may be difficult to analyze in downhole environments.

Currently, DFA is restricted to station measurements.

According to the present invention, DFA is performed continuously during the production from a well.

According to an aspect of the present invention, a fluid phase separator is employed to deliver samples of a single phase fluid suitable for sensor use.

A downhole fluid analysis tool according to the present invention includes a phase separator configured for downhole operation having a phase separation chamber to receive downhole fluids containing at least two phases, and at least two output ports in fluid communication with the chamber each for the output of a respective phase, and a downhole fluid analysis module in fluid communication with the output ports and configured for downhole operation that includes a plurality of sensors for characterization of properties of the phases.

In one embodiment of the present invention, the phase separator is a gravity phase separator that includes a phase extraction tube residing within the phase separation chamber having a plurality of perforations that are in fluid communication with the separation chamber. To temporarily store separated phase, the separation chamber includes a first space to receive a first phase and a second space to receive a second phase, wherein the first one of the at least two output ports is in direct fluid communication with the first space and the second one of the at least two output ports is in direct fluid communication with the second space. The phase separation chamber may further include an intake port in fluid communication with an inlet tube. In one embodiment the tool may include a retractable arm coupled to the inlet tube for the positioning of the inlet tube inside the borehole.

A tool according to the present invention may further include at least one fluid conditioner positioned to receive a selected phase prior to the sensors, and at least one injector positioned to receive a selected phase prior to the sensors.

The downhole fluid analysis module in a tool according to the present invention may further include at least one chamber disposed to receive a selected phase after the sensors, and a discard port disposed to receive and discard a selected phase after the sensors.

Thus, a method according to the present invention includes receiving a downhole fluid that includes at least two immiscible phases, such as a water containing phase and a hydrocarbon containing phase, in a borehole at a subsurface location, separating one phase from another phase to obtain two separated phases in the borehole at the subsurface location, selecting one of the separated phases in the borehole at the subsurface location, and performing fluid analysis on the selected separated phases in the borehole at the subsurface location.

In the preferred embodiment, gravity is used to separate the phases.

According to an aspect of the present invention, processing such as phase separation is performed to obtain separated phases each having a mass size not smaller than a sensor size, whereby more accurate readings can be obtained.

According to another aspect of the present invention because of the relatively rapid speed of the downhole fluids passing the sensors, e.g. 1 meter per second, sensors are configured for rapid analysis, for example a rate in excess of 1 kHz.

Other features and advantages of the present invention will become apparent from the following description of the invention which refers to the accompanying drawings.

DETAILED DESCRIPTION OF EMBODIMENTS OF THE INVENTION

To enable a downhole fluid analysis module (DFAM) to measure more accurately the properties of downhole fluids during production logging, sample downhole fluids (i.e. formation fluids in the borehole at the subsurface location) are collected in the borehole at a subsurface location during production logging, and processed for analysis at the subsurface location.

According to one aspect of the present, the sample of the downhole fluids so collected, which includes at least two immiscible phases (e.g. a water containing phase and a hydrocarbon containing phase) is subjected to phase separation to obtain separated phases for analysis. Thus, according to one aspect of the present invention, feeding of phases to the DFAM having mass sizes less than the size of the sensors in the DFAM is avoided, which allows for a more accurate measurement of the properties of the fluids in the borehole at the subsurface location.

Figure 1:
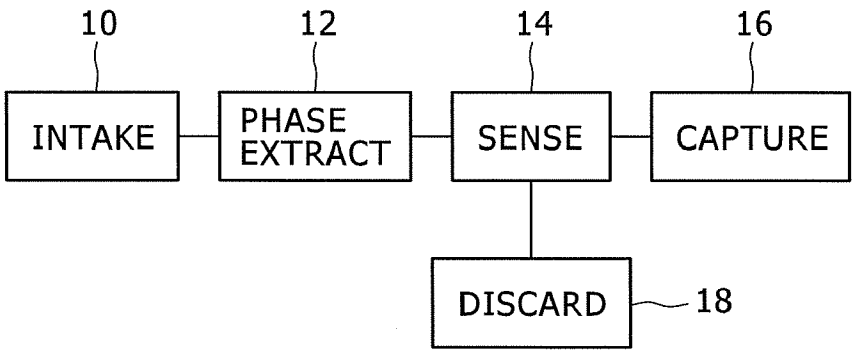
FIG. 1 illustrates a block diagram representing a method according to an embodiment of the present invention.

Referring to FIG. 1, a method according to the present invention includes intaking (or collecting) 10 of a sample of downhole fluids, phase extraction 12, sensing 14, and capturing 16 the sample, or discarding the sample all carried out in the borehole at a subsurface location. Intaking 10 involves the collection of a sample of downhole fluids during production logging, which requires the sample to be taken from the borehole at a subsurface location. Phase extraction 12 involves separating the various phases of the sample and then selecting and taking one of the separated phases for analysis at the subsurface location. Sensing 14 involves the analysis of the selected and taken extracted phases by various downhole fluid property sensors, and capturing 16 or discarding 18 the sample at the subsurface location which can take place after sensing 14 procedures have been completed.

Figure 2:
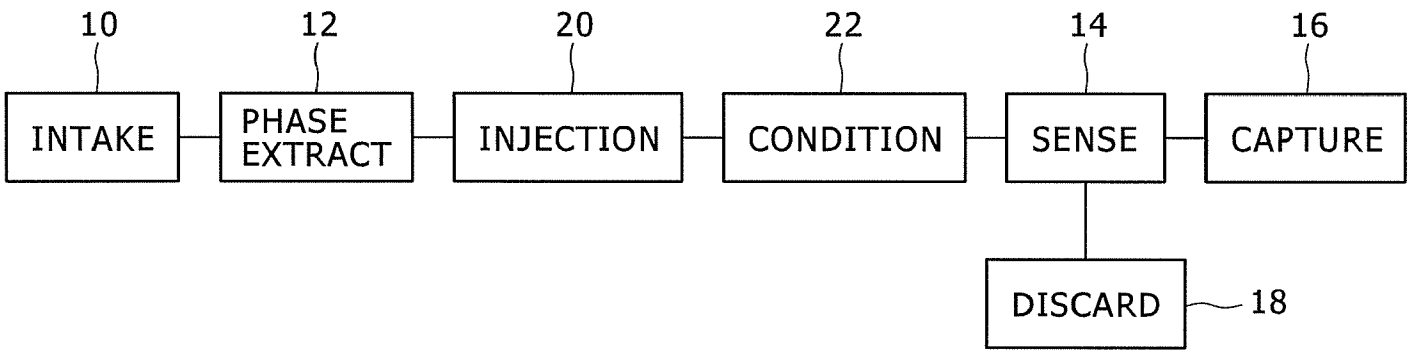
FIG. 2 illustrates a block diagram representing a method according to another embodiment of the present invention.

Referring now to FIG. 2, in which like numerals identify like features, in the preferred embodiment of the present invention, the extracted phase may be subjected to further processing prior to sensing 14. Thus, optionally, the extracted phase may be subjected to fluid injection 20 or the like in order to change a property thereof prior to sensing 14, and/or subjected to conditioning 22 in order to change a physical characteristic thereof prior to sensing 14. Note that it is not necessary for fluid injection 20 to precede conditioning 22 if both are used. Rather, conditioning 22 can precede fluid injection 20. Moreover, it should be noted that in a tool capable of fluid injection 20 or conditioning 22 according to an embodiment of the present invention, it would not be necessary to perform both.

Figure 3:
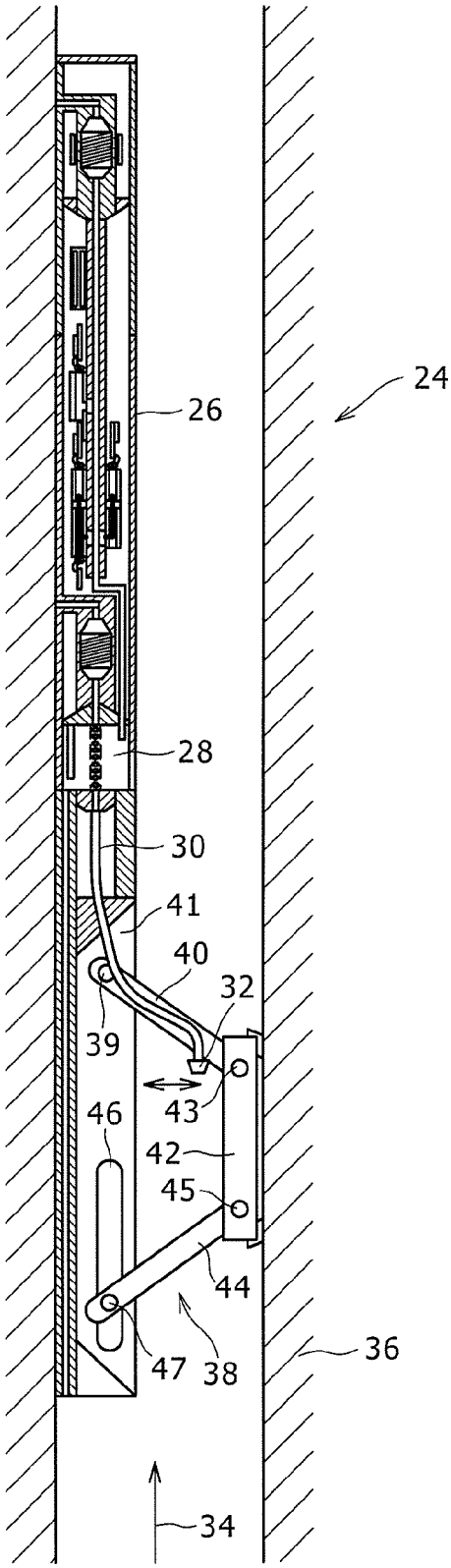
FIG. 3 schematically depicts one embodiment of a tool according to the present invention.

FIG. 3 schematically depicts one embodiment of a tool 24 capable of downhole fluid analysis during production logging according to an embodiment of the present invention. Tool 24 includes a DFAM 26, a gravity phase separator 28 in fluid communication with DFAM 26, and a flexible intake tube 30 in fluid communication with gravity phase separator 28 all supported by frame 41 of tool 24. In practice, tool 24 is suspended from a wire line and lowered into the borehole. The wire line may include input/output communication wires as well as power lines coupled to the sensors and other devices of tool 24. The communication wires can be used to collect information from the sensors for surface analysis, or send signals to direct the operation of devices of tool 24. Power wires are used to power the device of tool 24.

Inlet tube 30 includes a sucking inlet 32 which is positioned in the path of moving downhole fluid 34 in borehole 36 in order to collect downhole fluid. Inlet tube 30 is preferably mechanically coupled to a repositioning arm 40 of a retractable arm assembly 38. Repositioning arm 40 is pivotally coupled to a portion of frame 41 of tool 24 at one end thereof using a pivot pin 39 and pivotally coupled to an end of a transmission arm 42 of assembly 38 using a pivot pin 43. Transmission arm 42 is pivotally coupled at another end thereof to an end of a motion arm 44 using a pivot pin 45. Motion arm 44 includes a slidable pin 47 at another end thereof which is slidably received in a corresponding slot 46 in frame 41 of tool 24. Slot 46 is preferably a vertically oriented straight channel that lies along a common line that crosses the center of pin 39. Thus, the vertical sliding of slidable pin 47 (i.e. parallel to the longitudinal axis of borehole 36) in slot 46 will cause the horizontal motion of transmission arm 42, thereby making it possible to adjust the position of sucking inlet 32 in borehole 36.

The downhole fluid entering inlet tube 30 is received inside of gravity phase separator 28, and subject to phase separation. Thereafter, DFAM 26 selectively receives one of the separated phases to perform downhole fluid analysis therein.

Phase separator 28 is preferably designed for bi-phase separation of two fluid phases A and B having a density contrast. For example, Phase A has a density that is less than Phase B. Thus, due to gravity, Phase A would rise above (closer to the surface and further from the bottom of the borehole) Phase B in a container. An example of Phase B would be a water containing phase and an example of a Phase A would be a hydrocarbon containing phase such as crude oil.

Figure 4:
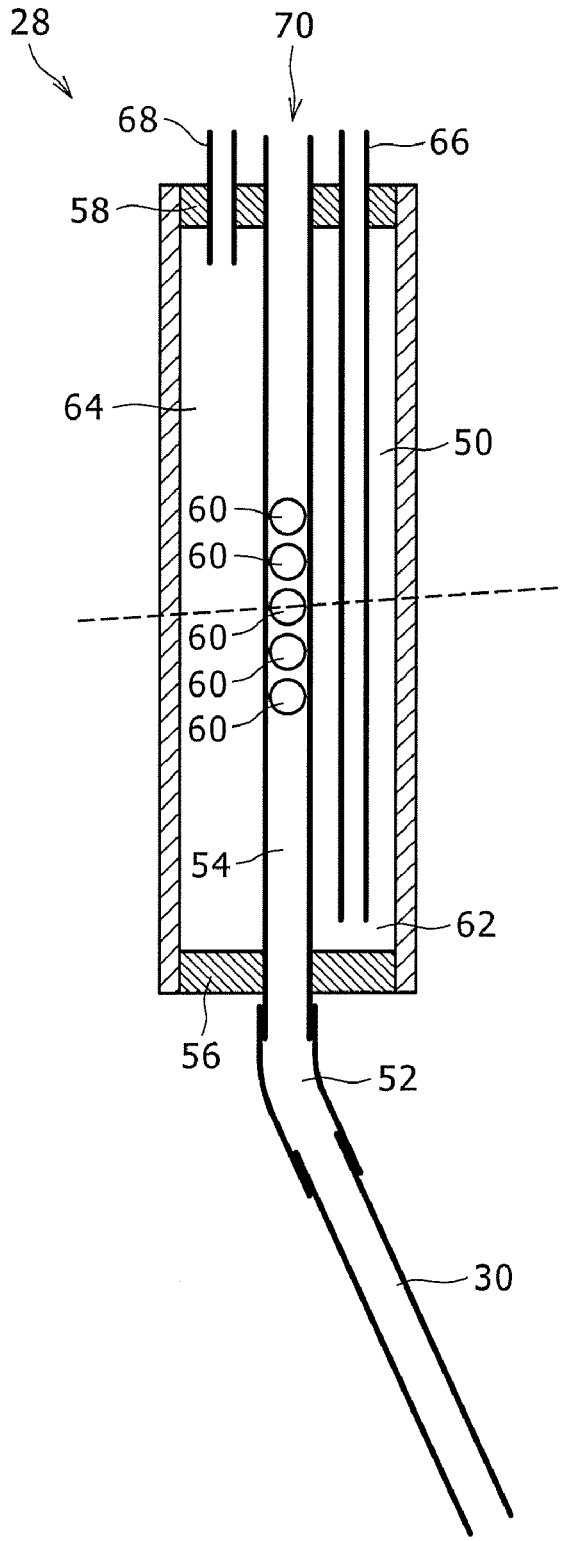
FIG. 4 schematically depicts a gravity phase separation chamber in an embodiment of a tool according to the present invention.

Referring now to FIG. 4, phase separator 28, which is configured to operate in the high pressure and temperature of a downhole operation environment, preferably includes phase separation chamber 50, which is in fluid communication with inlet tube 30 through an intake port 52. Inlet port 52 is preferably a flexible coupling which is coupled at one end thereof to an end of inlet tube 30, and at another end thereof to an open end of phase extraction tube 54. Phase extraction tube 54 extends preferably from the exterior of base 56 of chamber 50 through the top end 58 of chamber 50. Phase extraction tube 54 includes a plurality of spaced perforations 60 parallel to the longitudinal axis and at preferably a common side thereof. Downhole fluid containing at least two immiscible fluid phases A,B transported through tube 30, intake port 52, and through extraction tube 54 are fed into chamber 50 through perforation 60. Note that preferably extraction tube 54 is positioned such that perforations 60 are in the middle portion of chamber 50.

Chamber 50 includes a first space 62, which is adjacent base 56 (closer to the bottom of the borehole) thereof, and second space 64, which is adjacent top end 58 (closer to the surface) thereof. Thus, Phase B, which is designated as the denser fluid, for example, gathers adjacent base 56 in first space 62, and Phase A, which is the less dense fluid, for example, gathers above Phase B and inside at least a portion of space 64 in chamber 50. Chamber 50 includes a first output port 66 (which may be a tube) extending through top 58 and reaching first space 62, and second output port 68 (which may also be a tube) extending through top 58 and only into second space 64. Thus, in operation first output port 66 is in direct fluid communication with first space 62 but not at all in fluid communication with space 64, and is able to receive Phase B gathered therein, and second output port 68 is in fluid communication with second space 64 only, and is able to receive Phase A gathered therein.

In the preferred embodiment, DFAM 26 is in fluid communication with first output port 66, and second output port 68 to selectively receive Phase A or Phase B for analysis. Note that output end 70 of extraction tube 54 may be coupled to a pump which may itself be in communication with the borehole.

Figure 5:
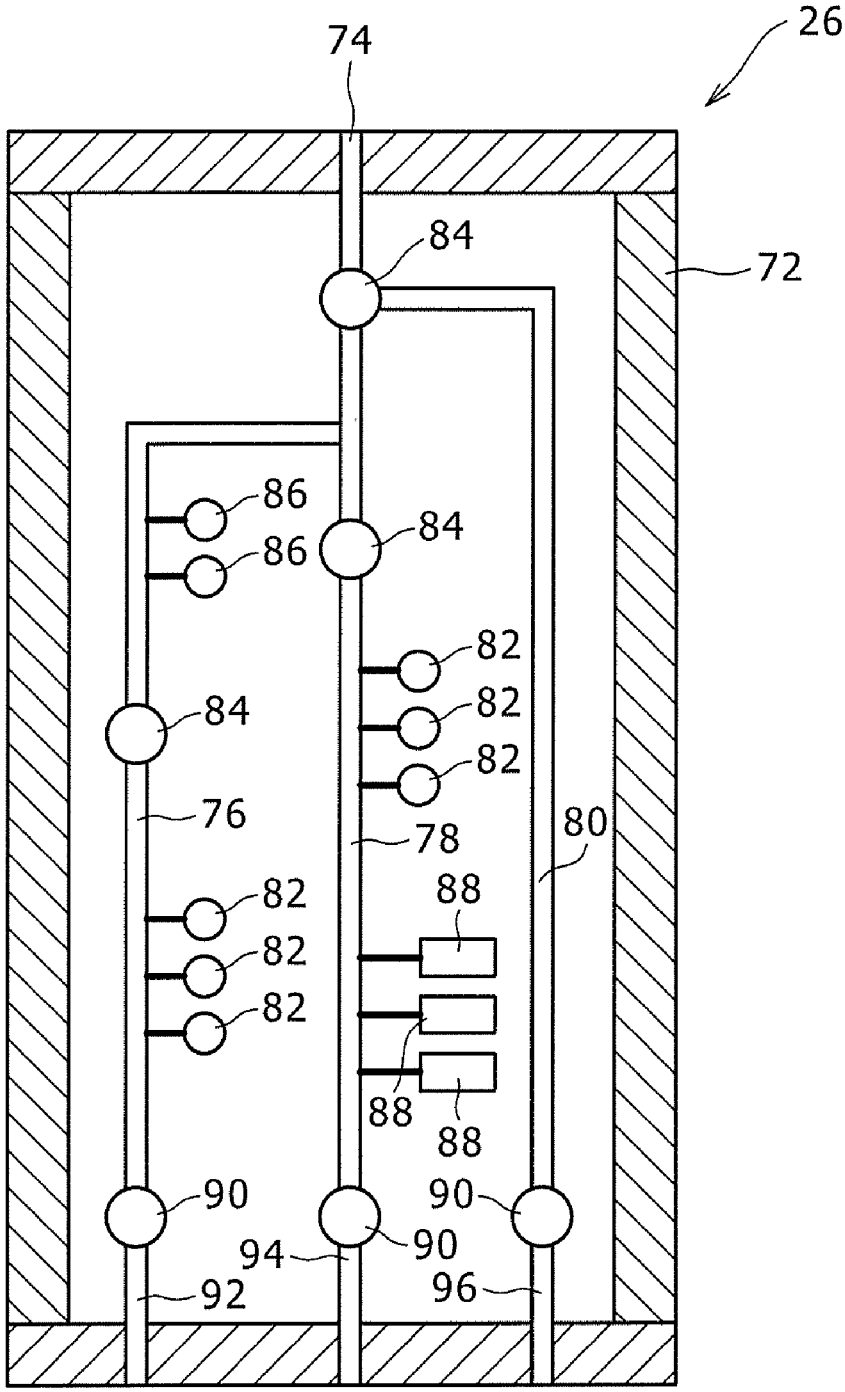
FIG. 5 schematically depicts an embodiment of a downhole fluid analysis module for production logging used in a tool according to an embodiment of the present invention.

Referring now to FIG. 5, a DFAM, which is configured for operation in the high pressure and high temperature conditions of a downhole environment, preferably includes at least one pump connected to end 70 of extraction tube 50, and another pump selectively connectable to first output port 66 or second output port 68 depending on whether Phase A or Phase B is to be analyzed. Thus, according to an aspect of the present invention, only a single fluid phase is received by DFAM 26 for analysis.

Briefly summarized, DFAM 26 includes a straight flow line with suitable sensors connected in series to the line of flow of the extracted fluid phase. The network of tubing directs the extracted fluid phase toward different sensors used for characterization of the extracted fluid phase. The fluid phase inside the network can be either rejected/expelled outside the tool after analysis by different sensors has been performed, or can be captured inside the tool in sample chambers in order to retrieve the fluids at the surface for further analysis. The measurements of the properties of the extracted fluids by different sensors can be used to determine if a sample is worth taking or not for further analysis.

Referring now to FIG. 5, DFAM 26 preferably includes a network of tubes. Each portion of the network of tubes is preferably in series with a flowline that supplies a selected extracted fluid phase. Specifically, DFAM 26 includes a housing 72, and an input flow line 74, which is preferably a tube that is connected for fluid transport to a plurality of tubes inside housing 72. For example, three tubes 76, 78, 80 may be disposed inside housing 72 and connected to input flow line 74 at one end thereof.

Tube 76 may include a plurality of sensors 82 serially disposed along the line of fluid flow, at least one fluid conditioner 84 disposed along the line of fluid flow prior to sensors 82, and a plurality of fluid injectors 86 disposed along the line of fluid flow prior to conditioner 84.

Fluid line 78 may include sensors 82 serially disposed along the line of fluid flow, a fluid conditioner serially disposed along the line of flow of fluid prior to sensors 82, and a plurality of sample chambers 88 serially disposed along the line of fluid flow after sensors 82 to collect samples as desired for surface analysis.

Fluid line 80 is connected to a fluid conditioner 84'. Note that in the example shown, conditioner 84' may be disposed between input fluid line 74 and all lines 76, 78, 80 as illustrated. Each line 76, 78, 80 may be provided with a respective pump 90, which is connected between the line and a respective output line 92, 94, 96. Each output line 92, 94, 96 is preferably a pipe which extends through housing 72 and is in fluid communication with the exterior of housing 72 to selectively discard any samples received by DFAM 26.

Fluid conditioners 84 can be used to change the physical properties of the extracted fluid phase. The changes in the physical properties may be necessary or desirable to operate sensors 82 properly. For example, fluid pressure and velocity can be changed with restrictors located inside the tubes, and the temperature of the extracted fluid can be changed by local heaters located on the flow line. Fluid conditioners 86 can also include phase separators in order to separate the water, oil and gas that may be in the flow line.

Fluid injectors 86 may be used to mix chemicals with the extracted fluid phase in order to change its properties before it is analyzed by sensors 82.

Sensors 82 include chemical sensors to determine the presence and identify chemicals present in the extracted fluid, sensors for measuring the physical properties of the extracted fluid, sensors for measuring the composition of the extracted fluid, among others. Fluid measurements that are required for downhole fluid analysis or in-situ fluid characterization: GOR, optical spectral determination of composition, $H_2S$, pH, water ion chemistry, fluorescence, density, viscosity.

The pressure difference required to drive the fluid through the network of tubes in DFAM 26 can be generated either by a passive or an active system.

In an active system, one or more pumps can be used to generate the pressure necessary to move the extracted fluid through the pipes as described above.

In a passive system, the difference of pressure generated by the flow around the tool is used to move the fluid through the network of pipes. The pressure difference naturally occurs as the flow progresses in the borehole. In a passive system, the pressure difference can be enhanced to suck the fluid through the tool.

DFA in a continuous logging measurement in production logging is different than a station measurement at the surface. A tool 24 according to the present invention would need to descend at considerable velocity, which means sampling will be conducted at a rate commensurate with the speed of the tool. Thus, the measurement rate must correspond with the fluid sampling system. For example, when there is no fluid storage time, and for fluid flow rates relative to the sensor of 1 m/sec and for a sensor of 1 mm, the sensor time constant needs to be in excess of 1 kHz. For some sample residence time (for instance in a phase separator), the measurement time constant can be reduced. Moreover, because time variation of fluid properties is of particular interest, the tool must be calibrated with proper algorithms to account for the tool response time.

A tool according to the present invention can capture a multiphase sample and then allow isolated single phases to flow past the sensor at proper rates. Advantageously, a tool according to the present invention can prevent a sensor from contacting more than one phase at a given time.

Preferably, a tool 24 according to the present invention will perform measurements on fluids taken above and below perforations in a zone of interest to understand the properties of the fluids at the perforations of interest. In the case of a multi-zone well, for example, in order to get the fluid property from a zone of interest out of all the zones, the fluid property must be known and extracted below and above perforations in the zone of interest while the tool is residing within the zone of interest. Station measurements above and below perforations in the zone of interest may be then made in order to determine the difference in the hydrocarbon or water. Station measurements are performed downhole at the zone of interest in order to carry out in-situ fluid characterization. Thus, according to another aspect of the present invention, fluid property is measured above and below the perforations in the zone of interest and the difference in the measurements is calculated, whereby the property of the fluid in the zone of interest can be attained.

For injection of fluids immiscible in the continuous phase, one might have separate drops of newly injected fluids along with drops from lower perforations (or upper perforations if there is countercurrent flow). Especially for finite residence times, there might be miscible mixing of fluids produced at different perforations. In any event, comparison of the properties of the fluids below and above the perforations of interest is a unique aspect of downhole fluid analysis during production logging according to the present invention and will be of critical interest. Algorithms that are focused on revealing this difference would be employed. In principle, the algorithms would measure the fluid property at each zone, determine the difference between the zones, and then through analysis obtain the fluid property at a zone of interest.

In an alternative embodiment, a tool according to the present invention could include sensors that are mounted on moveable arms that penetrate into the fluid flow, instead of sensors inside a tool housing. In the alternative embodiment, the fluids could be transported to the sensors, and the separation of the different phases or different analytes could be accomplished via membranes. In particular, small volumes could be acquired and examined by very small sensors.

Preliminary tests aimed at sampling water from a two phase flow have indicated that a 1 11/16" diameter separator of length 6" with a residence time of 40 seconds will consistently produce water with less than 100 ppm of visible oil, the worst case being a vertical flow, with all other deviations towards horizontal performing better. For the vertical flow situation, the maximum oil droplet diameter (typically <100 μm) is shown to be determined directly from Stokes' law. The mean droplet size is of the order 10 μm. Equivalent results and conclusions have also been obtained when a modified separator is used to extract oil from a flowing mixture.

According to another aspect of the present invention, DFA can be performed periodically during production from the well. Specifically, PL-DFA according to the present invention can perform periodic DFA at a zone of interest; whereas, a conventional DFA for open hole can not do so. Thus, periodic monitoring can provide information relating to the change in the property of the fluid at the zone of interest in the reservoir. The information so obtained can reveal changes in the characteristics of the reservoir, which would then allow for the optimization of production from the well.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A downhole fluid analysis tool, comprising:

a phase separator configured for downhole operation that includes a phase separation chamber to receive downhole fluids having at least two phases, and at least two output ports in fluid communication with said phase separation chamber each for the output of a respective phase; and a downhole fluid analysis module in fluid communication with said output ports and configured for downhole operation that includes a plurality of sensors for characterization of properties of said phases.

2. A downhole fluid analysis tool according to claim 1, further comprising a phase extraction tube residing within said phase separation chamber, said phase extraction tube including a plurality of perforations that communicate with said separation chamber.

3. A downhole fluid analysis tool according to claim 1, wherein said chamber includes a first space for a first phase and a second space for a second phase, said first one of said at least two output ports in direct communication with said first space and said second one of said at least two output ports in direct communication with said second space.

4. A downhole fluid analysis tool according to claim 1, wherein said phase separation chamber includes an intake port in fluid communication with an inlet tube.

5. A downhole fluid analysis tool according to claim 4, further comprising a retractable arm coupled to said inlet tube.

6. A downhole fluid analysis tool according to claim 1, further comprising at least one fluid conditioner.

7. A downhole fluid analysis tool according to claim 6, wherein said fluid conditioner is positioned to receive a selected phase prior to said sensors.

8. A downhole fluid analysis tool according to claim 1, further comprising at least one injector.

9. A downhole fluid analysis tool according to claim 8, wherein said injector is positioned to receive a selected phase prior to said sensors.

10. A downhole fluid analysis tool according to claim 1, wherein said downhole fluid analysis module further includes at least one chamber disposed to receive a selected phase after said sensors.

11. A downhole fluid analysis tool according to claim 1, further comprising a discard port disposed to receive and discard a selected phase after said sensors.

12. A downhole fluid analysis tool according to claim 1, wherein said phase separator is a gravity phase separator.

13. A method for downhole fluid analysis, comprising:

receiving a downhole fluid that includes at least two immiscible phases in a borehole at a subsurface location;

separating one phase from another phase to obtain two separated phases in said borehole at said subsurface location;

selecting one of said separated phases in said borehole at said subsurface location; and performing fluid analysis on said selected separated phases in said borehole at said subsurface location.

14. A method according to claim 13, wherein one of said phases includes water and the other one of said phases includes hydrocarbons.

15. A method according to claim 13, wherein gravity is used to separate said phases.

16. A method according to claim 13, wherein said selected phase is subjected to physical conditioning prior to performing fluid analysis.

17. A method according to claim 13, wherein fluid is injected into said selected phase prior to performing fluid analysis.

18. A method according to claim 13, wherein said fluid analysis includes at least one of pH measurement, $CO_2$ measurement, and $H_2S$ measurement.

19. A method according to claim 13, wherein a phase extraction tube including a plurality of vertically-oriented perforations is used to separate said phases, and further comprising performing fluid analysis on extracted fluid from a position above a zone of interest and a position below said zone of interest to determine a difference in characteristics between said fluid extracted from above said zone of interest and fluid extracted from below said zone of interest.

20. A downhole fluid analysis method using sensors configured for downhole operation having a sensor size, comprising:

receiving in a borehole at a subsurface location a downhole fluid that includes at least two immiscible phases;

processing in said borehole at said subsurface said downhole fluid to obtain separated phases each having a mass size not smaller than said sensor size; and performing property measurements on at least one of said phases at said subsurface location.

21. A downhole fluid analysis method according to claim 20, wherein said property measurement is performed at a rate in excess of 1 kHz.

22. A downhole fluid analysis method using sensors configured for downhole operation, comprising:

continuously receiving in a borehole at a subsurface location a downhole fluid during production of hydrocarbons from said borehole; and performing property measurements on said downhole fluid, wherein said downhole fluid is received at an interval based on a travel time relative to said downhole fluid and size of each of said sensors, and wherein said property measurment on said downhole fluid are performed at a rate which corresponds with said interval.

23. A method according to claim 22, wherein said performing property measurements is carried out periodically.

* * * * *